US006740858B2

(12) United States Patent
Tracy et al.

(10) Patent No.: US 6,740,858 B2
(45) Date of Patent: May 25, 2004

(54) MICROWAVE HEATING APPLICATOR FOR HEATING A MOVING FLUID

(75) Inventors: Michael L. Tracy, Beverly, MA (US); Dennis R. Gautreau, Milford, NH (US); Todd A. Treado, Merrimac, MA (US)

(73) Assignee: Communications and Power Industries, Inc., Beberly, MA (US)

( * ) Notice: Subject to any disclaimer, the term of this patent is extended or adjusted under 35 U.S.C. 154(b) by 61 days.

(21) Appl. No.: 10/160,666

(22) Filed: May 30, 2002

(65) Prior Publication Data

US 2002/0179596 A1 Dec. 5, 2002

Related U.S. Application Data

(60) Provisional application No. 60/363,579, filed on Mar. 12, 2002, and provisional application No. 60/295,296, filed on Jun. 1, 2001.

(51) Int. Cl.[7] ..... H05B 6/74; H05B 6/78

(52) U.S. Cl. ..... 219/687; 219/690; 219/695; 219/696; 219/750; 422/186; 422/21; 210/748

(58) Field of Search ..... 219/687, 688, 219/689, 690, 695, 696, 697, 745, 746, 748, 749, 750, 686; 422/186, 21; 588/1, 227; 210/748

(56) References Cited

U.S. PATENT DOCUMENTS 3,590,202 A * 6/1971 Day et al. ..... 219/696
4,694,133 A * 9/1987 Le Viet ..... 219/689
5,122,633 A * 6/1992 Moshammer et al. ..... 219/687
5,237,152 A * 8/1993 Gegenwart et al. .... 219/121.47
5,439,596 A * 8/1995 Ohmi et al. ..... 210/748

* cited by examiner

*Primary Examiner*—Philip H. Leung
(74) *Attorney, Agent, or Firm*—Nutter, McGlennen & Fish, LLP

(57) ABSTRACT

A microwave applicator for heating a moving fluid includes a heating chamber having a fluid inlet and a fluid outlet and through which the fluid to be heated flows. The applicator also includes a microwave energy source and a microwave circuit having at least one wave-guide element. The microwave circuit transforms microwave energy from the microwave source into a cylindrical wave-guide mode within the heating chamber for uniformly heating fluid flowing through the heating chamber. This technology is also applied as a method for applying microwave energy for heating a moving fluid. This method includes passing a fluid from a fluid inlet, through a heating chamber, and out a fluid outlet; and applying a microwave energy source through a microwave circuit including at least one wave-guide element to transform microwave energy from the microwave energy source into a cylindrical wave-guide mode within the heating chamber to uniformly heat the fluid flowing through the heating chamber.

36 Claims, 7 Drawing Sheets

MICROWAVE HEATING APPLICATOR FOR HEATING A MOVING FLUID

CROSS REFERENCE TO RELATED APPLICATIONS

This application claims priority to U.S. Provisional Patent Application No. 60/363,579, entitled "Microwave Applicator for Fluid Heating," and filed on Mar. 12, 2002; and also to U.S. Provisional Patent Application No. 60/295,296, entitled "Microwave Heating System," and filed on Jun. 1, 2001; both of which applications are hereby incorporated by reference.

FIELD OF THE INVENTION

The present invention relates to systems and methods for heating a moving liquid or slurry using microwave energy. More particularly, the invention provides uniform heating throughout the desired heating volume by applying higher order resonance modes in a cylindrical wave-guide.

BACKGROUND OF THE INVENTION

A variety of food processing and other industrial processes require continuous heating of a moving liquid or slurry. This heating was once performed, for example, by using steam or hot water jackets to surround pipes carrying the fluid of interest, or by using heat exchangers. More recently, microwave heating has been employed to provide the required heating for these processes.

One example of microwave heating is provided in U.S. Pat. No. 5,697,291 to Burgener et al. This patent describes a continuous flow thermal pasteurization and enzyme inactivation method and apparatus for economically and precisely raising the temperature of a flowing fluid to a point at which bacterial and enzymes are inactivated. This method and apparatus involve two stages. In a first preheat stage, the fluid is preheated to within several degrees of the pasteurization or inactivation temperature using heat regenerated from the pasteurization or inactivation product, or by using heat provided by surface conductance from a heated vapor, heated liquid or a heated element. In the second or final of the two heating stages, the preheated fluid is gradually heated with microwave heating to the pasteurization or inactivation temperature for precisely and evenly controlling the temperature of the fluid. Preferably, the microwaves are applied to the fluid through the forced absorption of energy over substantially long lengths of product tubing.

In another example of microwave heating of a moving fluid in an industrial process, U.S. Pat. No. 5,719,380 to Coopes et al. provides an apparatus for heating mixtures in the manufacture of photographic dispersions. In this apparatus, a chamber for receiving microwave energy input is provided in the form of a section of rectangular wave-guide where the wave-guide is dimensioned to propagate an input of microwave energy in the $TE_{10}$ field mode. The wave-guide section is terminated by a short circuiting metal plate, which sets up a standing electromagnetic wave inside the wave-guide. A straight length of microwave transparent tubing passes transversely through the wave-guide and the fluid to be heated is passed through the tubing.

For many industrial heating processes, the solutions described above are not sufficient. In particular, many industrial heating processes require rapid heating with good uniformity (to prevent, for example, localized boiling) throughout a large volume. This can be a particularly challenging problem when heating a heterogeneous solution such as a slurry, or a fluid flowing through or over a catalyst.

SUMMARY OF THE INVENTION

The present invention addresses the problems in the prior art by providing a microwave applicator capable of uniformly heating large volumes of fluid or heterogeneous fluid solid combinations while minimizing hot spots that can cause localized boiling. In one aspect, the invention provides a microwave applicator for heating a moving fluid. The applicator includes a heating chamber having a fluid inlet and a fluid outlet and through which the fluid to be heated flows. The applicator also includes a microwave energy source and a microwave circuit having at least one wave-guide element. The microwave circuit transforms microwave energy from the microwave source into a cylindrical wave-guide mode within the heating chamber for uniformly heating fluid flowing through the heating chamber. In a further aspect of the invention, this technology is applied as a method for applying microwave energy for heating a moving fluid. This method includes passing a fluid from a fluid inlet, through a heating chamber, and out a fluid outlet; and applying a microwave energy source through a microwave circuit including at least one wave-guide element to transform microwave energy from the microwave energy source into a cylindrical wave-guide mode within the heating chamber to uniformly heat the fluid flowing through the heating chamber.

In specific embodiments of the invention, the microwave circuit transforms microwave energy from the energy source into a cylindrical wave-guide mode that is higher than the dominant mode. In separate embodiments, the microwave circuit transforms microwave energy from the microwave energy source into the $TE_{21}$ cylindrical wave-guide mode and into the $TM_{11}$ cylindrical wave-guide mode, respectively. In addition, the microwave circuit can be configured to transform a majority of the microwave energy into a single wave-guide mode that is higher than the dominant mode, and in a more specific embodiment, can be configured to transform substantially all of the microwave energy into a single wave-guide mode that is higher than the dominant mode.

To achieve the desired transformations and excite a cylindrical wave mode, the microwave circuit can include an rf match cavity, the rf match cavity being a cylindrical chamber surrounding the heating chamber. The rf match cavity can also include two input ports for receiving microwave energy via the microwave circuit. In order to provide energy to two ports, the microwave circuit can further include a three port signal divider, a first wave-guide element extending between the microwave energy source and a first port of the three port signal divider, a second wave-guide element extending between a second port of the three port of the three port signal divider and a first input port of the rf match cavity, and a third wave-guide element extending between a third port of the three port signal divider and a second input port of the rf match cavity. In a specific embodiment used to excite the $TE_{21}$ cylindrical wave mode, the three port signal divider is a T-coupler directing microwave energy out through the second and third ports wherein the microwave energy at one of the second and third ports is 180° out of phase with microwave energy at the other of the second and third ports.

In further specific embodiments of the invention, safety is enhanced by providing a region surrounding the heating chamber with a pressurized gas. To provide such a region, the microwave circuit can include a dielectric window that maintains pressure surrounding the heating chamber by allowing microwave energy to pass while preventing the gas from passing through the window. The microwave circuit can further include a full height to half height transition leading into the pressure window so that the pressure window has a reduced surface area.

To aid in applying the invention to heating fluids passing through catalyst material, the heating chamber can include at least one catalyst support screen to maintain a catalyst material within the heating chamber. Even under these circumstances, heating applicators of the invention provide uniform heating throughout a mixture of catalyst material and a moving absorptive fluid having different dielectric constants.

BRIEF DESCRIPTION OF THE DRAWINGS

The invention will be more fully understood from the following detailed description taken in conjunction with the accompanying drawings.

DETAILED DESCRIPTION OF THE INVENTION

The present invention provides a system and method for microwave heating of absorptive fluids. The invention can be applied to moving fluids, slurries, and, in particular, to heating fluids passing through a heterogeneous catalyst bed. The invention provides uniform irradiation over a large volume, and can minimize the likelihood of explosion in the heating system as the microwaves are directed into a resonant cavity which can be pressurized with nitrogen or another inert gas while the absorptive fluid is maintained within a tube formed from microwave translucent material.

Figure 1:
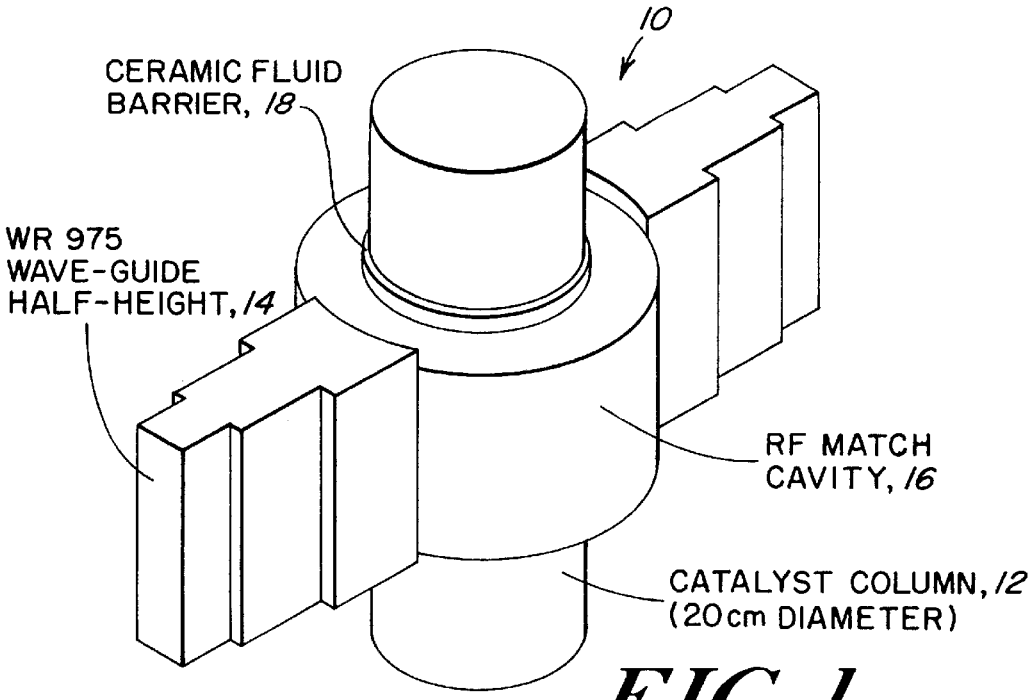
FIG. 1 illustrates an internal geometry for a heating applicator of the invention.

FIG. 1 illustrates the internal geometry of an illustrative embodiment of a microwave heating system 10 of the invention. System 10 is designed to heat an absorptive fluid flowing through a generally cylindrical heating chamber or catalyst column 12. Microwave energy is directed into catalyst column 12 through two wave-guides 14 which feed into a cylindrical RF match cavity 16. From RF match cavity 16, the microwave energy is transformed into a cylindrical wave-guide mode as it passes through a ceramic fluid barrier 18 for heating fluid passing through catalyst column.

Figure 1A:
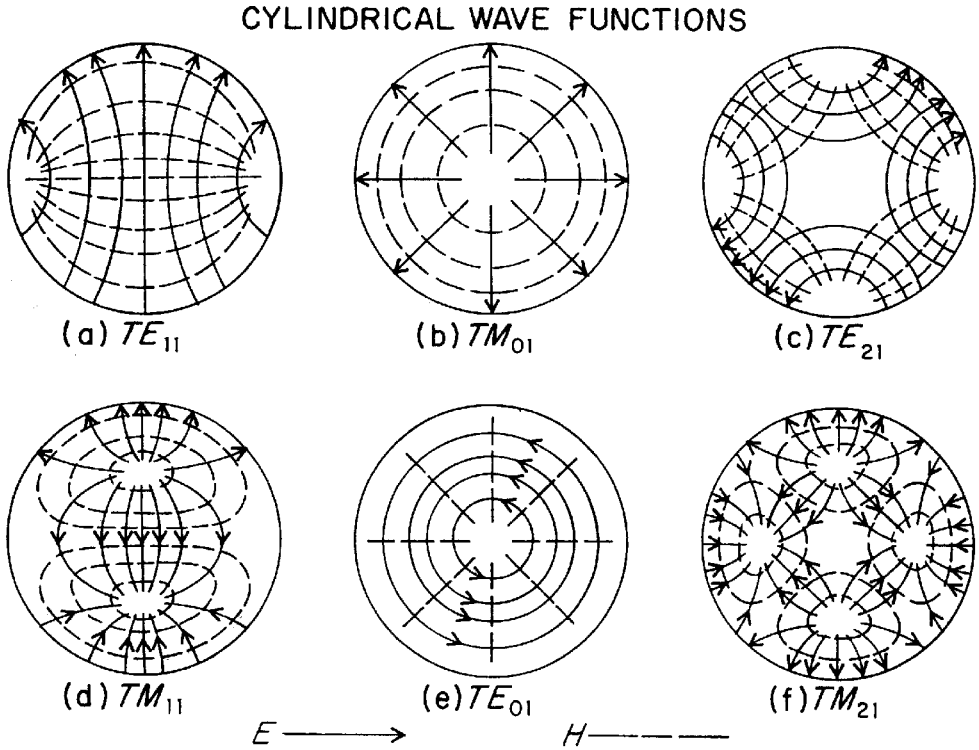
FIG. 1A provides diagrammatic representations of a number of cylindrical wave functions including those used in the illustrated embodiments of the invention.

Typically, microwave energy in a cylindrical wave-guide is provided in the dominant $TE_{11}$ mode (see FIG. 1A). The lower-order cylindrical wave-guide modes illustrated in FIG. 1A are shown in order of increasing cutoff frequency (see, Harrington, Roger F., Time-Harmonic Electromagnetic Fields, IEEE Press (1991), pages 198 to 263 (which is hereby incorporated herein by reference) for a thorough treatment of cylindrical wave functions). Accordingly, by using the dominant $TE_{11}$ mode and designing a wave-guide system to cut off those frequencies that are higher than the cutoff frequency of the $TE_{11}$, a person of ordinary skill in the art could be confident that only one wave mode would be present in the system, allowing improved control over the application of microwave energy to the desired end.

The inventors have discovered, however, that by a applying microwave energy in a cylindrical wave-guide in a wave mode that is higher than the dominant mode, even heating may be achieved throughout a larger volume (as might be required for heating a fluid flowing through a catalyst bed) than is possible using the dominant mode. In one preferred embodiment illustrated below, microwave energy is provided in a $TE_{21}$ wave-guide mode. In a further exemplary embodiment, microwave energy is provided in a $TM_{11}$ wave-guide mode. In addition, the majority of the microwave energy applied for heating in systems of the invention is provided in the wave-guide mode of choice, and, preferably, substantially all of the microwave energy is applied in the wave-guide mode of choice.

Figure 2:
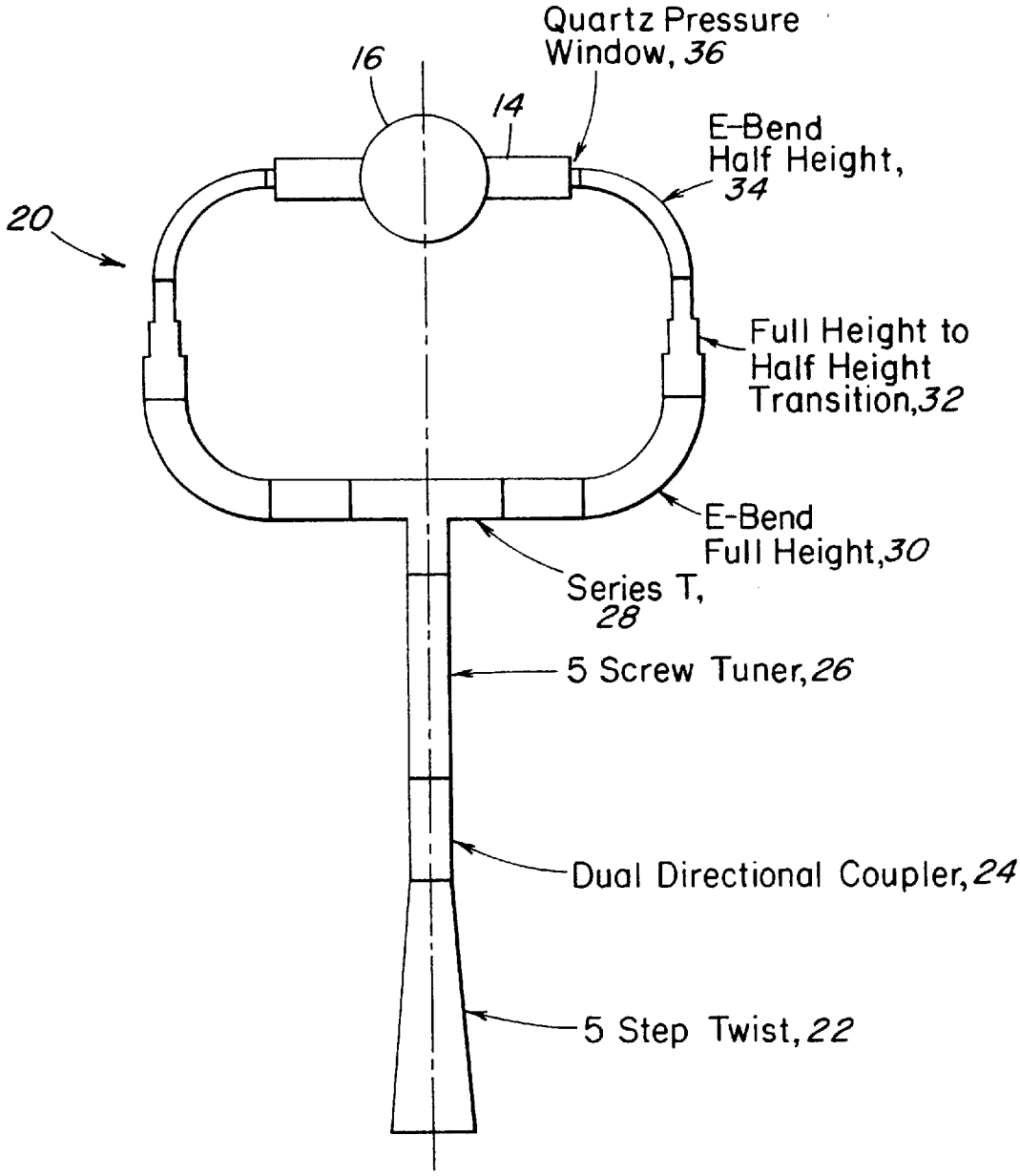
FIG. 2 is a diagrammatic view of a microwave circuit useful with the heating applicator of FIG. 1.

Common microwave energy sources, such as those used in commercial food processing applications, may be used with a system of the invention. These microwave energy sources typically operate at frequencies of 915 MHz or 2450 MHz, and either frequency, as well as other w frequencies, may be used with a system of the invention. FIG. 2 illustrates an exemplary microwave circuit 20 for transforming the output of a microwave energy source into a desired cylindrical wave mode for use in heating system 10.

The first element in microwave circuit 20 is a five step twist element 22. This element 22 is used to change the orientation of polarized microwave energy should such an orientation change be desired or required. A dual directional coupler 24 is used to monitor power flow in both forward and reverse directions so that microwave circuit 20 can be properly tuned. A five-screw tuner 26 is also provided in circuit 20. Tuner 26 can be used to tune circuit 20 to compensate for any mismatch in heating system 10 and to stop the reflection of microwave energy in a reverse direction through circuit 20. Such a mismatch might occur if, for example, it is difficult or impossible to obtain perfect data regarding the moving fluid that is being heated, thus making it difficult to model the impedance in the circuit. In such a circumstance, the flow of power can be measured at dual directional coupler 24 during operation of heating system 10 and five screw tuner 26 can be adjusted until the desired levels are achieved.

A series "T" coupler 28 is provided in order to split the microwave energy to be applied in heating system 10 into two components in order to provide the energy into rf match cavity 16 in the desired geometry which, for the $TE_{21}$ cylindrical wave mode, involves two collinear microwave energy entry ports spaced 180° apart about the circumference of cylindrical rf match cavity 16. This configuration also requires that one output arm be 180° out of phase with the other output arm of series T coupler 28. In keeping with the described geometry, a first bend 30 is provided downstream of each output arm of series T coupler 28. A second bend 34 is also provided on each side of circuit 20 to complete the geometry required to connect to wave-guide elements 14 which meet microwave energy entry ports in rf match cavity 16.

A further feature of microwave circuit 20 is its ability to maintain a pressurized environment about heating chamber/ catalyst column 12. A pressure window 36 is provided leading to each microwave energy entry port so that heating system 10 can be pressurized. Pressure window 36 must be capable of withstanding the desired pressurization, but must also allow microwave energy to pass through. One suitable material for pressure window 36 is quartz. A further feature provided in microwave circuit 20 to facilitate the described pressurization is a transition step from full height to half height 32 provided on either side of circuit 20 before each quartz pressure window 36. Because the pressurization force on each pressure window 36 rises with its surface area, the full height to half height transition 32 allows window 36 to be half the height it would otherwise be, correspondingly reducing the force on the window from the pressurization and thus allowing the window to be thinner than it otherwise would be.

Figure 3:
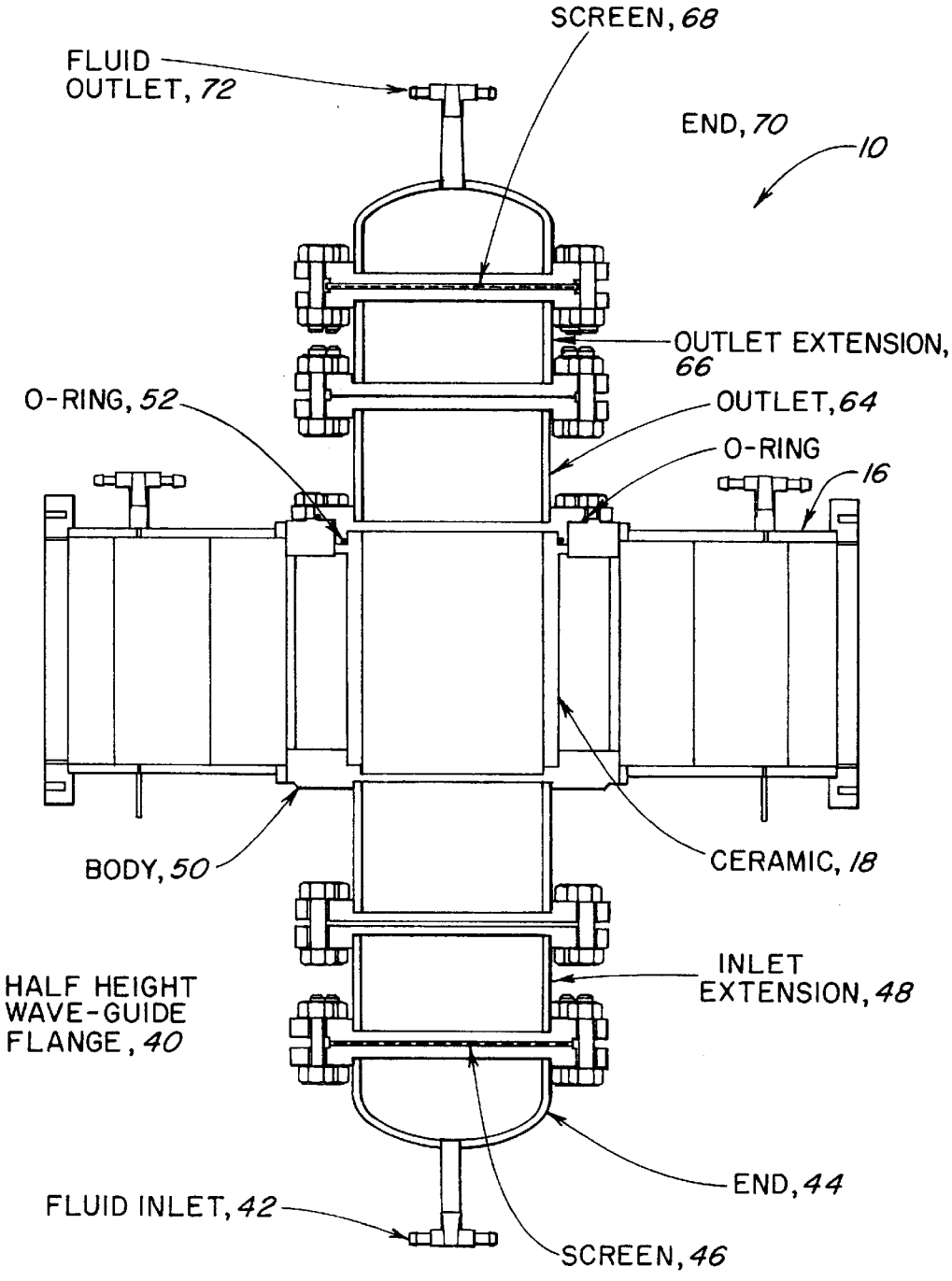
FIG. 3 is a cross-sectional view of the heating applicator whose internal geometry is illustrated in FIG. 1.

FIG. 3 illustrates in cross-section the heating system 10 whose internal geometry is illustrated in FIG. 1. Fluid to be heated enters heating system 10 through fluid inlet 42 into a first end 44 of system 10. In general, all of the fluid contacting elements should be formed from a material that is strong enough to withstand the heat and pressure applied within heating system 10 and should be formed from a material that will not corrode or otherwise react with the fluid being heated; in general, stainless steel is one preferred material from which these elements may be formed. A screen 46 can be provided to hold catalyst within heating system 10 while allowing fluid to pass in. As illustrated, an inlet extension 48 is provided (allowing for the capability of extending or reducing the length of a catalyst bed maintained within heating system 10) leading into the main body 50 of the heating system. In a central portion of body 50, a ceramic sleeve 18 is provided to maintain fluid (and catalyst if present) within the cylinder defined by body 50 while allowing microwave energy from rf match cavity 16 to pass through, the microwave energy entering the rf match cavity in the geometry described above by connection to waveguides 14 at half height wave-guide flanges 40. While a ceramic sleeve 18 is illustrated, a person of ordinary skill in the art will recognize that other materials could be used for sleeve 18 depending upon the application, such as, for example, Teflon.

Figure 4:
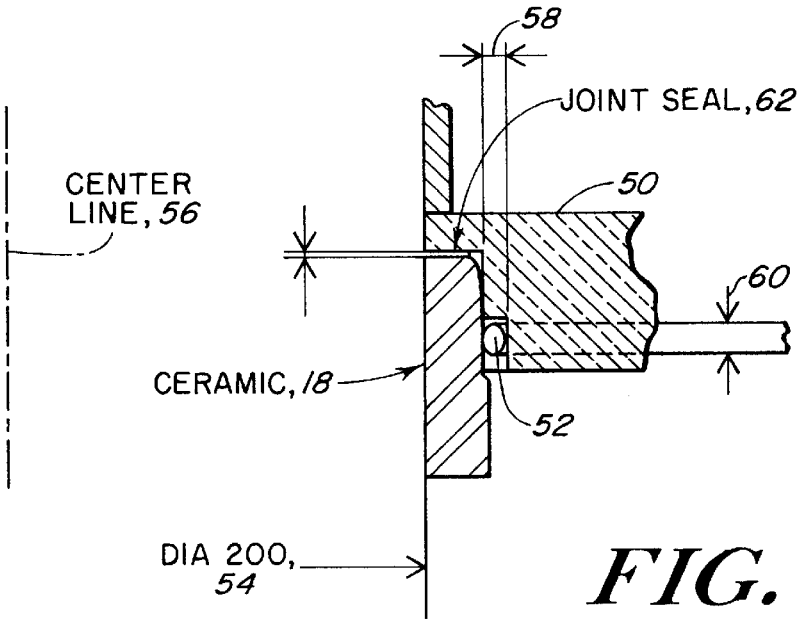
FIG. 4 is a cross-sectional view of a sleeve-body intersection within the heating applicator of FIG. 3.

An O-ring seal 52 (further illustrated in FIG. 4) can be provided between body 50 and ceramic sleeve 18 in order to seal the fluid within the cylinder. In FIG. 4, ceramic sleeve 18 is illustrated as maintaining the diameter 54 of the cylindrical heating region about a centerline 56. In one specific embodiment, this diameter is maintained at 200 millimeters. O-ring 52 can be placed in a groove in body 50 having a width 58 that is smaller than the diameter of the O-ring material while having a height 60 that is larger than the diameter of the O-ring material so that the O-ring may be squeezed between the sleeve 18 and body 50 while allowing room within the groove for the O-ring material to expand vertically. In one embodiment, primary seal O-ring 52 can be formed from Dupont Dow Kalrez Sahara compound 8575. A secondary joint seal 62 may also be provided between ceramic sleeve 18 and body 50 to prevent catalyst grit from reaching the primary seal O-ring. In the illustrated example, a compressible material (one such material is Gore-Tex Joint Seal DF10-25) is applied at each end of sleeve 18 and is compressed between the end of the sleeve and body 50.

Referring again to FIG. 3, the fluid continues to flow through heating system 10, reaching outlet 64, outlet extension 66, second screen 68, second end 70, and out through fluid outlet 72.

Figure 5:
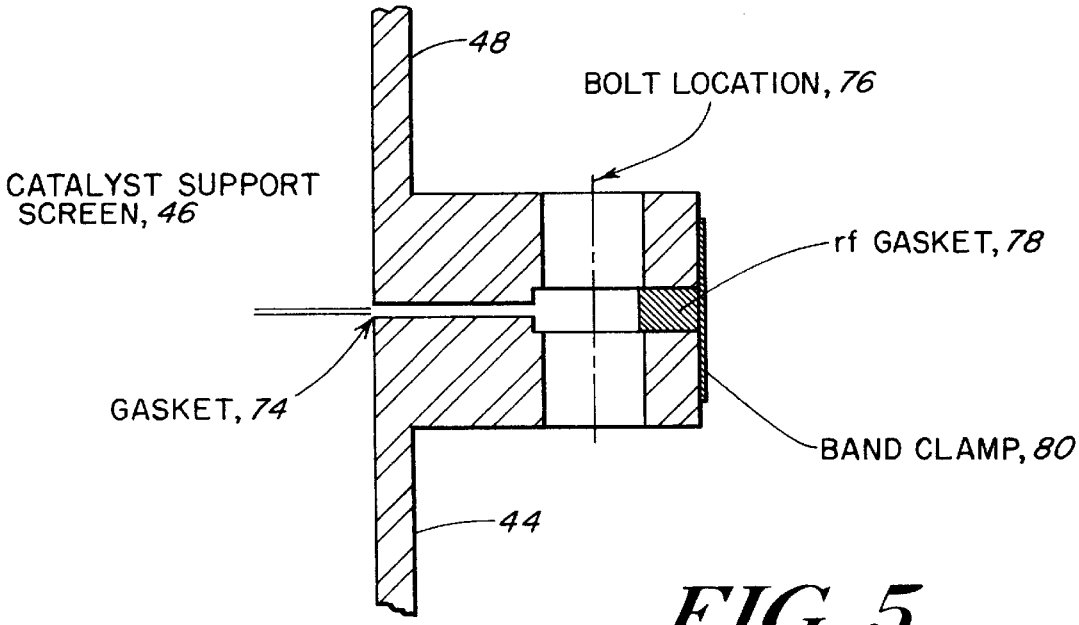
FIG. 5 is a cross-sectional view of a screen-body intersection within the heating applicator of FIG. 3.

The connections of the catalyst support screens 46, 68 are further illustrated by reference to an exemplary construction of first support screen 46 in FIG. 5. As illustrated, catalyst support screen 46 is clamped between flanges of first end 44 and inlet extension 48 with a gasket 74 to prevent fluid leakage between the flanges. When bolted closed (see bolt location 76), a direct metal to metal contact may not be made from first end 44 to inlet extension 48. As a result, an rf gasket 78, clamped into place by band clamp 80, may be provided to prevent rf energy from escaping heating system 10 in these regions.

The length of catalyst column 12 for the embodiment illustrated in FIGS. 1 though 5 can be calculated based on known or measurable parameters. In the illustrated embodiment, heating system 10 diameter could be taken as a given as illustrated at 200 millimeters. The complex dielectric constant can then be calculated from measurable values for the fluid, and in this case the fluid and catalyst, that will reside or pass through heating system 10 during the application of microwave energy. For example, the complex dielectric constant can be calculated using measured reflection, $s_{11}$, from an excitation probe connected to a $TM_{01}$ cylindrical mode resonant cavity. In this method, swept frequency, $s_{11}$ data is measured both with (perturbed) and without a small cylindrical sample placed at the center of the resonant cavity. From the sweep data, the resonance frequencies, $f_1$ and $f_2$, are those that minimize $|s_{11}|$ using the unpurterbed and perturbed cavity data, respectively. The dielectric constant of the sample can then be caculated according to:

$$\epsilon_r'=1+(1/2)*(f_1-f_2)/f_2*V/v$$

where V is the cavity volume and v the sample volume. This calculation is further described in Fenske, Kurt and Devendra Misra, "Dielectrica Materials at Microwave Frequencies," Applied Microwave & Wireless, October 2000 (Technical Feature), which is hereby incorporated by reference.

The imaginary part of the dielectric constant can be calculated using swept reflection data by first calculating the unloaded cavity Q factor. The unloaded Q values are calculated from $s_{11}$ data using the method given in Kajfez, Darko and Eugene J. Hwan, "Q-Factor Measurement with Network Analyzer," IEEE Transactions of Microwave Theory and Technique, vol. MTT-32, no. Jul. 7, 1984, which is hereby incorporated by reference. It should be noted that using the loaded $Q_L$ to calculate the loss term, $\epsilon''$, is not equivalent to using the unloaded $Q_0$. In order to use the loaded $Q_L$, the experimenter must ensure that coupling is very weak so that $Q_L$ is approximately $Q_0$. Using this method to calculate the unloaded Q values, $Q_1$ and $Q_2$, from the unperturbed and perturbed cavity data, respectively, the loss term for the dielectric constant can be calculated as:

$$\epsilon_r''=V/4v*(Q_2-Q_1)/Q_1Q_2$$

Small variations in the actual dielectric values from those calculated can be addressed using tuner 26 (FIG. 2) in microwave circuit 20 during operation of the circuit as described above.

Using three dimensional electromagnetic design and visualization software (such as, for example, CST Microwave Studio available from CST of America, Inc. of Wellesly, Mass.), the microwave system can be fully electrically designed, and, for the parameters used to design the embodiment of FIGS. 1 through 5 including applying microwave energy having a frequency of 915 MHz, the length of the cylindrical heating region, and thus the volume of fluid that can be heated, was determined to be adjustable depending on the placement of short circuit plates to select the number of resonant "hot" zones within the heating system. Simulating the distribution of electric field amplitude within heating system 10 shows that substantially all of the microwave energy is provided in the $TE_{21}$ mode and that uniform heating of fluid passing through this large volume of catalyst is achieved without localized hot spots that can cause boiling.

Figure 6:
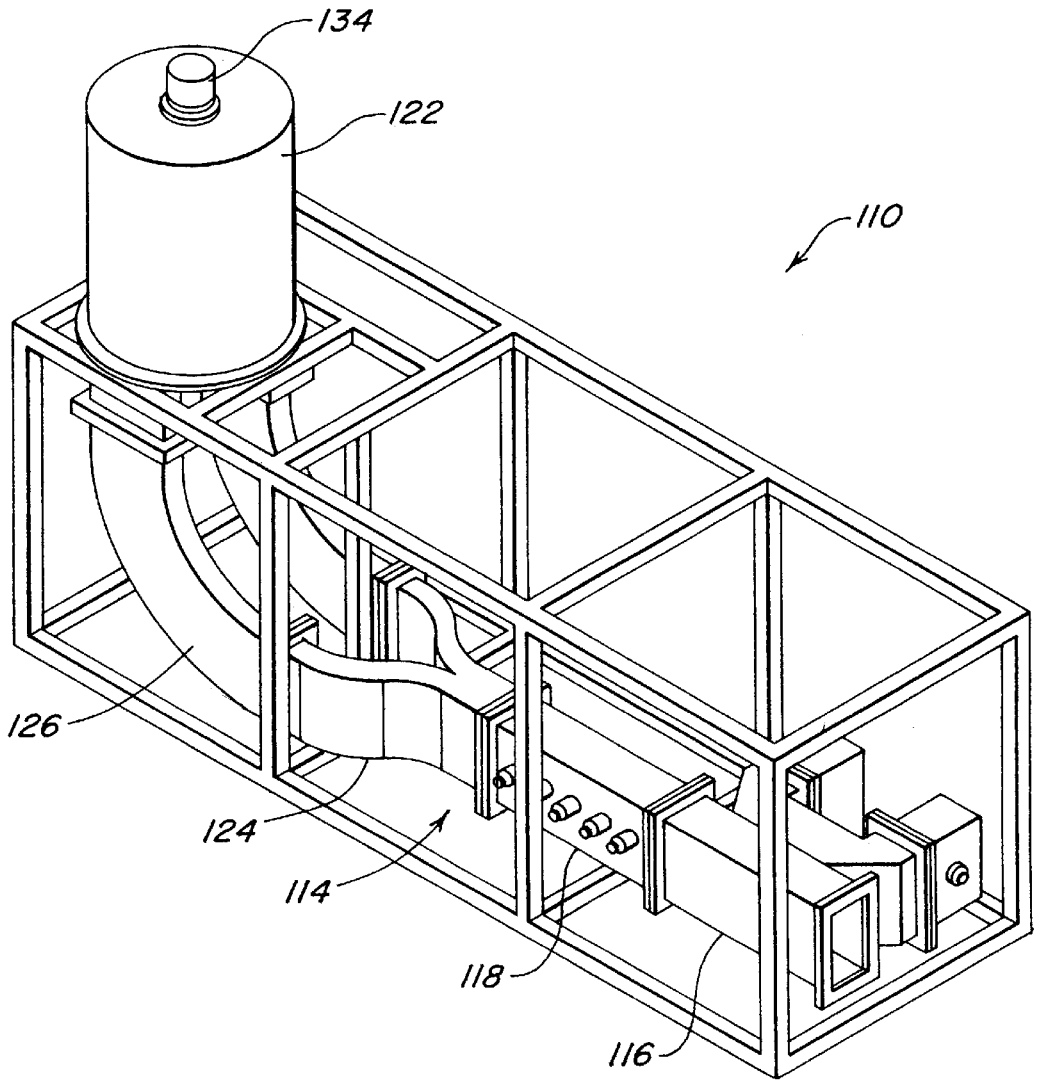
FIG. 6 is a perspective view of a heating system of the invention.
Figure 7:
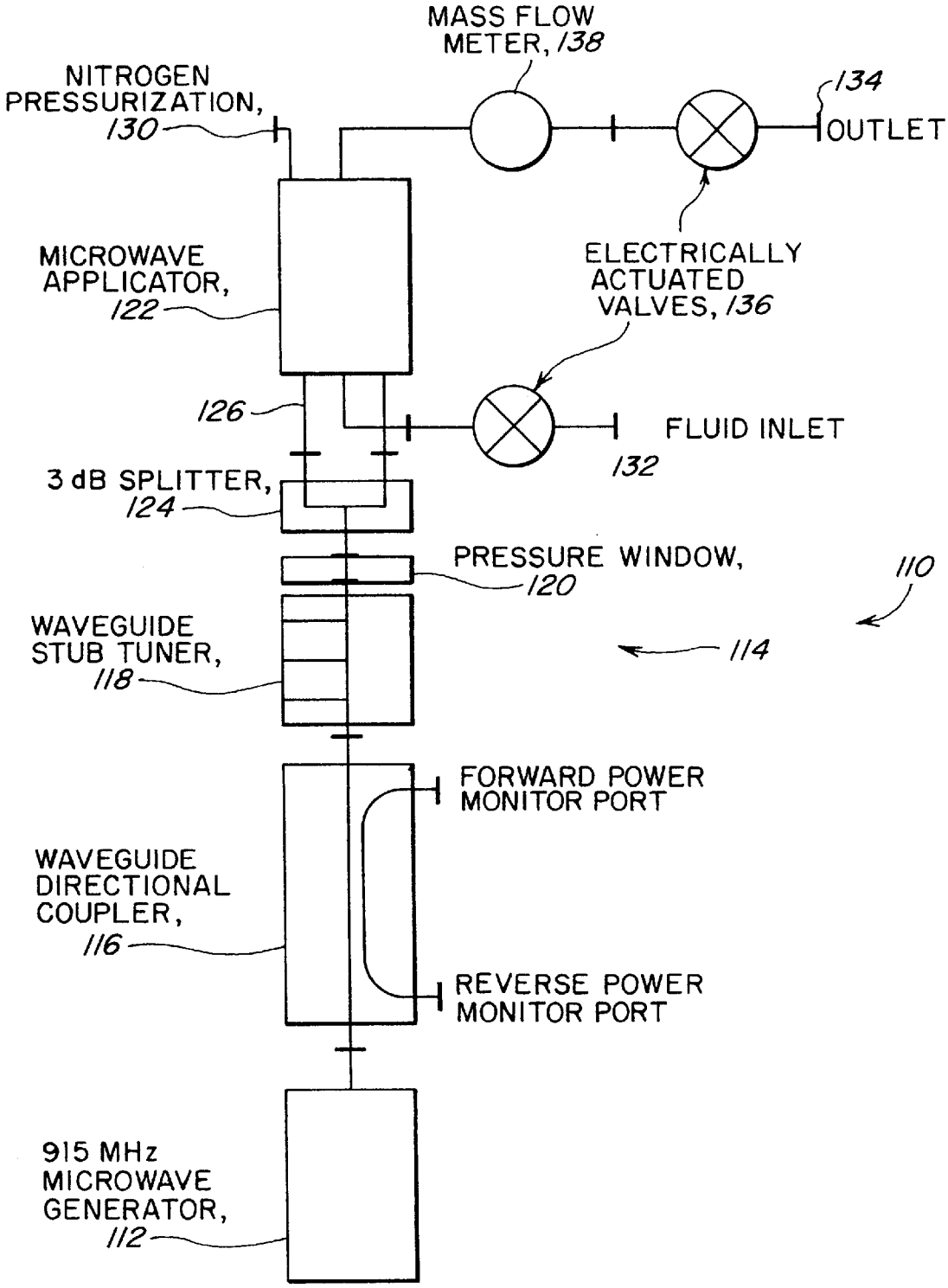
FIG. 7 is a diagrammatic representation of the system of FIG. 6.

A further embodiment of a system 110 of the invention, this embodiment operating in the $TM_{11}$ cylindrical wave-guide mode, is illustrated in FIGS. 6 and 7. In the embodiment of these figures, a microwave energy source 112 feeds microwave energy into a microwave circuit 112 that transforms the microwave energy from microwave energy source 112 into a cylindrical wave mode for application to a moving fluid. From microwave energy source 112, microwave energy propagates into a dual directional coupler 116 and a wave-guide tuner 118. As with the previous embodiment, directional coupler 116 and tuner 118 can be used to tune microwave circuit 114 under operational conditions to account for any mismatches in the circuit or inaccuracies in design resulting from an inability to accurately model the fluid being heated. A pressure window 120, similar to the pressure window provided above, can be placed in microwave circuit 114 so that the heating of the moving fluid can be pressurized.

As with the previously described embodiment, microwave circuit 114 must account for the input port geometry required to excite the cylindrical $TM_{11}$ wave mode, which, in this embodiment, calls for two input ports provided on one end of a cylindrical wave-guide 122. In this embodiment, a 3 dB signal splitter 124 is applied to split the microwave energy into two rectangular wave-guides 126 for connection to two input ports of cylindrical wave-guide 122.

Pressurized nitrogen 130 or another pressurized gas can be provided to cylindrical wave-guide 122 to pressurize the fluid column being heated. Fluid can enter cylindrical wave-guide for heating through a fluid inlet 132 and can exit through a fluid outlet 134, both of which may have valves 136 to control the flow of fluid and a mass flow meter 138 may also be provided.

Figure 8:
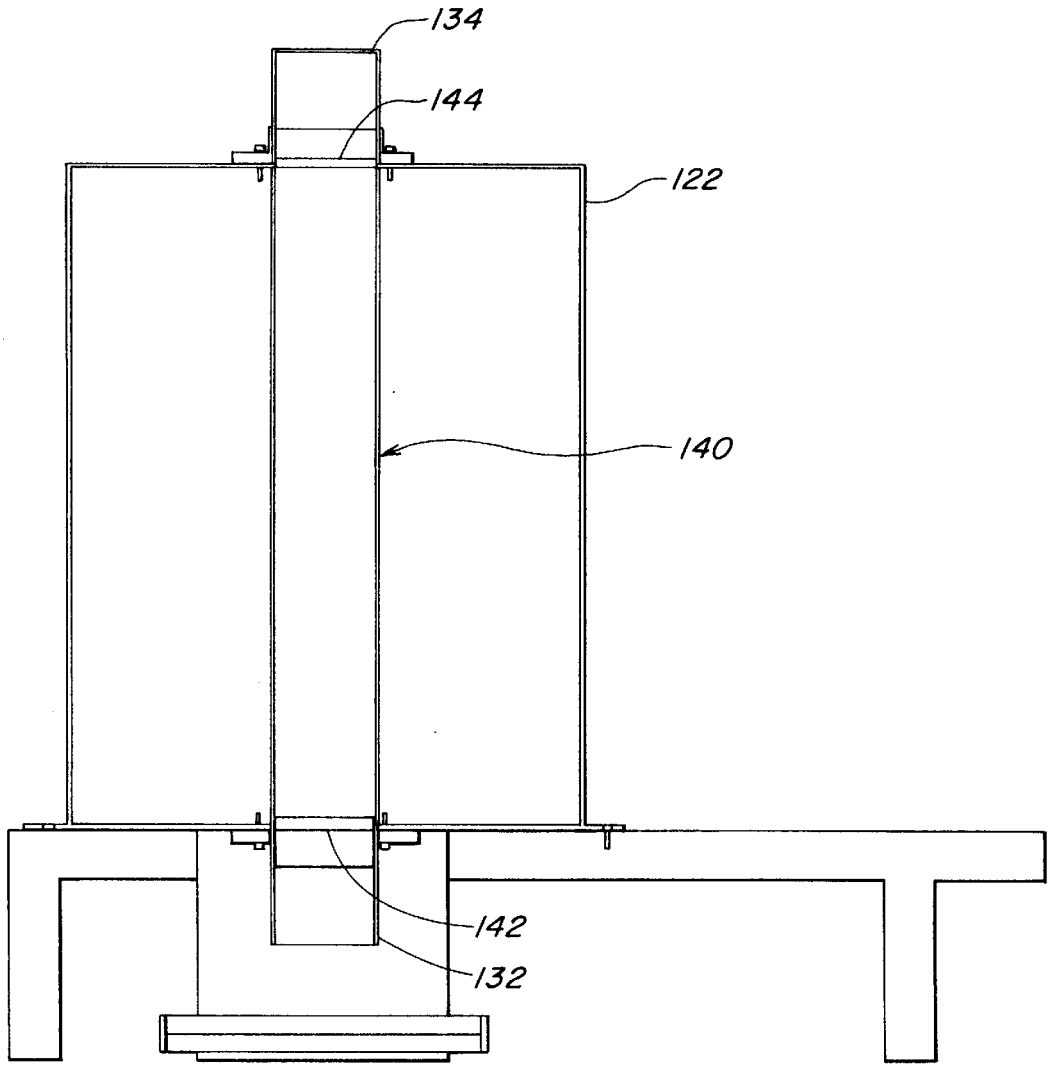
FIG. 8 is a cross-sectional view of a cylindrical wave-guide of the system of FIG. 6.

FIG. 8 illustrates a cross-section of cylindrical wave-guide 122 which shows a dielectric tube 140 located in the center of wave-guide 122 for transporting the fluid to be heated. Tube 140 can be made from the same materials as sleeve 18 above and performs the same function. Tube 140 can be provided with first and second screens 142, 144 which can hold a catalyst within tube 140. The configuration of the system of FIGS. 6 through 8 allows the fluid to be fed into the center of the cylindrical wave-guide cavity without geometric interference with the feed wave-guide. Simulation shows that the outer portion of wave-guide 122 acts as a power distribution system that feeds power into the central catalyst region at a uniform rate while the very high electric fields in the feed wave-guides do not impinge directly on the fluid being heated. Simulation also shows that a majority of the energy provided is in the $TM_{11}$ cylindrical wave mode.

A person of ordinary skill in the art will appreciate further features and advantages of the invention based on the above-described embodiments. For example, various elements and concepts employed in the embodiments of FIGS. 1 to 5 and 6 to 8 may be intermixed in a microwave applicator system within the spirit of the present invention. Accordingly, the invention is not to be limited by what has been particularly shown and described, except as indicated by the appended claims. All publications and references cited herein are expressly incorporated herein by reference in their entity.

What is claimed is:

1. A microwave applicator for heating a moving fluid comprising:

a heating chamber having a fluid inlet and a fluid outlet;

a microwave energy source; and a microwave circuit including at least one wave-guide element, the microwave circuit transforming microwave energy from the microwave source into a cylindrical wave-guide mode within the heating chamber for uniformly heating fluid flowing through the heating chamber;

wherein the microwave circuit includes an rf match cavity, the rf match cavity being a cylindrical chamber surrounding the heating chamber.

2. The applicator of claim 1, wherein the microwave circuit transforms microwave energy from the energy source into a cylindrical wave-guide mode that is higher than the dominant mode.

3. The applicator of claim 2, wherein the microwave circuit transforms microwave energy from the microwave energy source into a $TE_{21}$ cylindrical wave-guide mode.

4. The applicator of claim 2, wherein the microwave circuit transforms the microwave energy from the microwave energy source into a $TM_{11}$ cylindrical wave-guide mode.

5. The applicator of claim 2, wherein the microwave circuit is configured to transform a majority of the microwave energy into a single wave-guide mode that is higher than the dominant mode.

6. The applicator of claim 2, wherein the microwave circuit is configured to transform substantially all of the microwave energy into a single wave-guide mode that is higher than the dominant mode.

7. The applicator of claim 1, wherein the rf match cavity includes two input ports for receiving microwave energy via the microwave circuit.

8. The applicator of claim 7, wherein the microwave circuit further includes three port signal divider, a first wave-guide element extending between the microwave energy source and a first port of the three port signal divider, a second wave-guide element extending between a second port of the three port of the three port signal divider and a first input port of the if match cavity, and a third wave-guide element extending between a third port of the three port signal divider and a second input port of the rf match cavity.

9. The applicator of claim 8, wherein the three port signal divider is a T-coupler directing microwave energy out through the second and third ports wherein the microwave energy at one of the second and third ports is 180° out of phase with microwave energy at the other of the second and third ports.

10. The applicator of claim 1, wherein a region surrounding the heating chamber is pressurized with a gas.

11. The applicator of claim 10, wherein the microwave circuit includes a dielectric window that maintains pressure surrounding the heating chamber by allowing microwave energy to pass while preventing the gas from passing through the window.

12. The applicator of claim 11, wherein the microwave circuit includes a full height to half height transition leading into the pressure window so that the pressure window has a reduced surface area.

13. The applicator of claim 1, wherein the microwave circuit further includes a tuner for tuning the circuit to provide impedance matching throughout the circuit.

14. The applicator of claim 1, wherein the heating chamber includes a dielectric tube for maintaining the moving fluid within the tube while allowing rf energy to propagate through the tube.

15. The applicator of claim 14, wherein the heating chamber includes at least one catalyst support screen to maintain a catalyst material within the heating chamber.

16. The applicator of claim 15, wherein the heating chamber holds catalyst material and a moving absorptive fluid.

17. The applicator of claim 16, wherein uniform heating is maintained throughout a mixture of catalyst material and a moving absorptive fluid having different dielectric constants.

18. A method for applying microwave energy for heating a moving fluid comprising:

passing a fluid from a fluid inlet, through a heating chamber, and out a fluid outlet; and applying a microwave energy source through a microwave circuit including at least one wave-guide element to transform a majority of the microwave energy from the microwave energy source into a single cylindrical wave-guide mode that is higher than the dominant mode within the heating chamber to uniformly heat the fluid flowing through the heating chamber.

19. The method of claim 18, wherein the microwave circuit transforms microwave energy from the microwave energy source into a $TE_{21}$ cylindrical wave-guide mode as the single cylindrical wave-guide mode.

20. The method of claim 18, wherein the microwave circuit transforms the microwave energy from the microwave energy source into a $TM_{11}$ cylindrical wave-guide mode as the single cylindrical wave-guide mode.

21. The method of claim 18, wherein the microwave circuit transforms substantially all of the microwave energy into a single wave-guide mode that is higher than the dominant mode.

22. A microwave applicator for heating a moving fluid comprising:

a heating chamber having a fluid inlet and a fluid outlet;

a microwave energy source; and a microwave circuit including at least one wave-guide element, the microwave circuit transforming a majority of the microwave energy from the microwave energy source into a single cylindrical wave-guide mode that is higher than the dominant mode within the heating chamber for uniformly heating fluid flowing through the heating chamber.

23. The applicator of claim 22, wherein the microwave circuit transforms microwave energy from the microwave energy source into a $TE_{21}$ cylindrical wave-guide mode as the single cylindrical wave guide mode.

24. The applicator of claim 22, wherein the microwave circuit includes an if match cavity, the rf match cavity being a cylindrical chamber surrounding the heating chamber.

25. The applicator of claim 24, wherein the rf match cavity includes two input ports for receiving microwave energy via the microwave circuit.

26. The applicator of claim 25, wherein the microwave circuit further includes three port signal divider, a first wave-guide element extending between the microwave energy source and a first port of the three port signal divider, a second wave-guide element extending between a second port of the three port of the three port signal divider and a first input port of the if match cavity, and a third wave-guide element extending between a third port of the three port signal divider and a second input port of the rf match cavity.

27. The applicator of claim 26, wherein the three port signal divider is a T-coupler directing microwave energy out through the second and third ports wherein the microwave energy at one of the second and third ports is 180° out of phase with microwave energy at the other of the second and third ports.

28. The applicator of claim 22, wherein a region surrounding the heating chamber is pressurized with a gas.

29. The applicator of claim 28, wherein the microwave circuit includes a dielectric window that maintains pressure surrounding the heating chamber by allowing microwave energy to pass while preventing the gas from passing through the window.

30. The applicator of claim 29, wherein the microwave circuit includes a full height to half height transition leading into the pressure window so that the pressure window has a reduced surface area.

31. The applicator of claim 22, wherein the heating chamber includes a dielectric tube for maintaining the moving fluid within the tube while allowing rf energy to propagate through the tube.

32. The applicator of claim 31, wherein the heating chamber includes at least one catalyst support screen to maintain a catalyst material within the heating chamber.

33. The applicator of claim 32, wherein the heating chamber holds catalyst material and a moving absorptive fluid.

34. The applicator of claim 33, wherein uniform heating is maintained throughout a mixture of catalyst material and a moving absorptive fluid having different dielectric constants.

35. The applicator of claim 22, wherein the microwave circuit is configured to transform substantially all of the microwave energy into a single wave-guide mode that is higher than the dominant mode.

36. A microwave applicator for heating a moving fluid comprising:

a heating chamber having a fluid inlet and a fluid outlet;

a microwave energy source; and a microwave circuit including at least one wave-guide element, the microwave circuit transforming microwave energy from the microwave source into a cylindrical wave-guide mode within the heating chamber for uniformly heating fluid flowing through the heating chamber;

wherein a region surrounding the heating chamber is pressurized with a gas and the microwave circuit includes a dielectric window that maintains pressure surrounding the heating chamber by allowing microwave energy to pass while preventing the gas from passing through the window, the microwave circuit further including a full height to half height transition leading into the pressure window so that the pressure window has a reduced surface area.

* * * * *